US005836716A

United States Patent [19]

Johnson et al.

[11] Patent Number: 5,836,716

[45] Date of Patent: Nov. 17, 1998

[54] DRAINAGE PIPE

[76] Inventors: Wm. Ralph Johnson, 721 Michelle Pl., Coppell, Tex. 75019; Raymond Johnson, III, 8865 FM 429, Kaufman, Tex. 75142

[21] Appl. No.: 795,988

[22] Filed: Feb. 5, 1997

[51] Int. Cl.[6] ..... E02B 11/00

[52] U.S. Cl. ..... 405/43; 52/169.5

[58] Field of Search ..... 905/43, 44, 45, 905/46, 47, 48; 52/36, 169.5

[56] References Cited

U.S. PATENT DOCUMENTS

| | | | |
|---|---|---|---|
| 3,422,626 | 1/1969 | Hanrahan | 405/43 |
| 3,753,352 | 8/1973 | McNally | 405/43 |
| 4,134,268 | 1/1979 | Elmore | 405/43 |
| 4,538,386 | 9/1985 | Dicello | 405/43 X |
| 4,577,997 | 3/1986 | Lehto et al | 405/43 |
| 4,679,963 | 7/1987 | Heath | 705/45 X |
| 4,812,339 | 3/1989 | Shibata et al. | 905/36 X |

FOREIGN PATENT DOCUMENTS

| | | | |
|---|---|---|---|
| 1458179 | 10/1966 | France | 405/73 |
| 77726 | 5/1982 | Japan | 405/43 |

*Primary Examiner*—Tamara L. Graysay
*Assistant Examiner*—Frederick L. Lagman
*Attorney, Agent, or Firm*—Daniel V. Thompson

[57] ABSTRACT

A subsurface drainage pipe includes a tubular main pipe body having inner and outer surfaces and a longitudinal central axis. Walls defining a plurality of slot-shaped apertures through the inner and outer surfaces along the length of the main pipe body are provided. The slot shaped apertures are angled with respect to the central axis.

5 Claims, 3 Drawing Sheets

DRAINAGE PIPE

TECHNICAL FIELD

This present invention relates to fluid conducting pipes, and more particularly relates to pipes suitable for dispensing a fluid in a subsurface drain.

BACKGROUND ART

There is nothing more disappointing to a customer and damaging to the reputation of a contractor than when a new building or landscape project fails to meet its design goals because drainage was given too little consideration. Proper drainage entails more than meeting minimum standards set by local building codes. Drainage needs include seasonal and site-specific problems. No single technology will prevent all damage from inadequate drainage.

Even the best architect or contractor cannot guarantee he has solved all drainage problems when he turns a completed project over to its developer or owner. He knows that perfecting drainage often takes years of fine tuning. It requires balance between irrigation and soil moisture retention, seasonal rainfall and evapotranspiration, microclimates and traffic patterns, and turf type and weed competition.

SURFACE DRAINAGE

Engineers and architects divide drainage into surface and subsurface. Surface drainage begins with shaping and smoothing the land into a watershed that directs runoff to ditches, catch basins, storm sewers or French drains. They also must try to prevent erosion by managing surface water so it will not reach damaging proportions, because water becomes a powerful force as it accumulates and develops speed.

Without proper surface drainage, subsurface drainage efforts are considerably more difficult. Surface drainage alone is often inadequate to assure soil moisture levels best suited for some types of turf grasses. Correcting surface drainage deficiencies is costly and disruptive once a landscape is installed. Poor soil moisture conditions affect the condition of the plant material and restrict the use of the site.

Any surface under 2 percent (50:1) slope is considered flat, and will not effectively remove water. The required slope for surface drainage is greater than that of a ditch, French drain or subsurface drain. These can be trenched with a laser to provide a drop of one to two feet per 200 feet of length. Water will move at a lesser slope, but enough slope must be provided so the velocity of the water in the pipe will move solids mixed with the water.

Thus, it often becomes necessary to correct surface drainage problems by the installation of a subsurface drain, known also as a French drain.

SUBSURFACE DRAINAGE

Subsurface drains depend upon infiltration and percolation of water through the soil. Soils vary in these characteristics. Water begins to enter the perforations in buried drain pipe when the soil next to the pipe becomes saturated. Once the soil is saturated, the water accepted by the pipe is limited by the size and number of openings. The size of the laterals and drainage mains can also restrict flow once they reach capacity.

Following a soil test, a contractor can accurately determine the necessary distance between parallel drain pipe and the effective depth of these devices. Variations between drainage products make it necessary to consult installation guidelines.

Heavy clay soils will require closer and shallower installation than sandy or loamy soils. These details will also be influenced by the typical rainfall of the locality and the "worst case scenarios" for the location.

French drains are trenches filled with pea gravel sloped to carry water away from an area. For more efficient drainage or longer runs, perforated drain pipe, surrounded by larger gravel, may be used in lieu of pea gravel alone. The perforated pipe may be connected to a solid drain line beyond the area with the drainage problem. They are an underground, out-of-sight, option to concrete drainage culverts.

A French drain picks up subsurface water from near the effected house or building, or from poorly drained other parts of the yard. Its destination is usually the street or a dry well. The drain typically consists of a sloping trench lined with soil-filter fabric and filled with gravel and a perforated pipe.

Unfortunately little design attention has been applied to optimizing the performance of perforated pipe used in French drains. The typical pipe used by contractors today is either hand-perforated plastic pipe, with circular apertures drilled by hand, or factory-perforated drain pipe originally intended to be used for with septic tank field drains. The drawbacks with the perforated pipes currently available is plugging by gravel and general inefficiency, for the hand-drilled pipe, and high cost for the factory-perforated septic tank drain pipe.

SUMMARY OF THE INVENTION

The present invention provides an optimized perforated drainage pipe for subsurface drains. The preferred pipe has angled slots through and along the wall of the pipe in opposite directions for each alternate slot.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
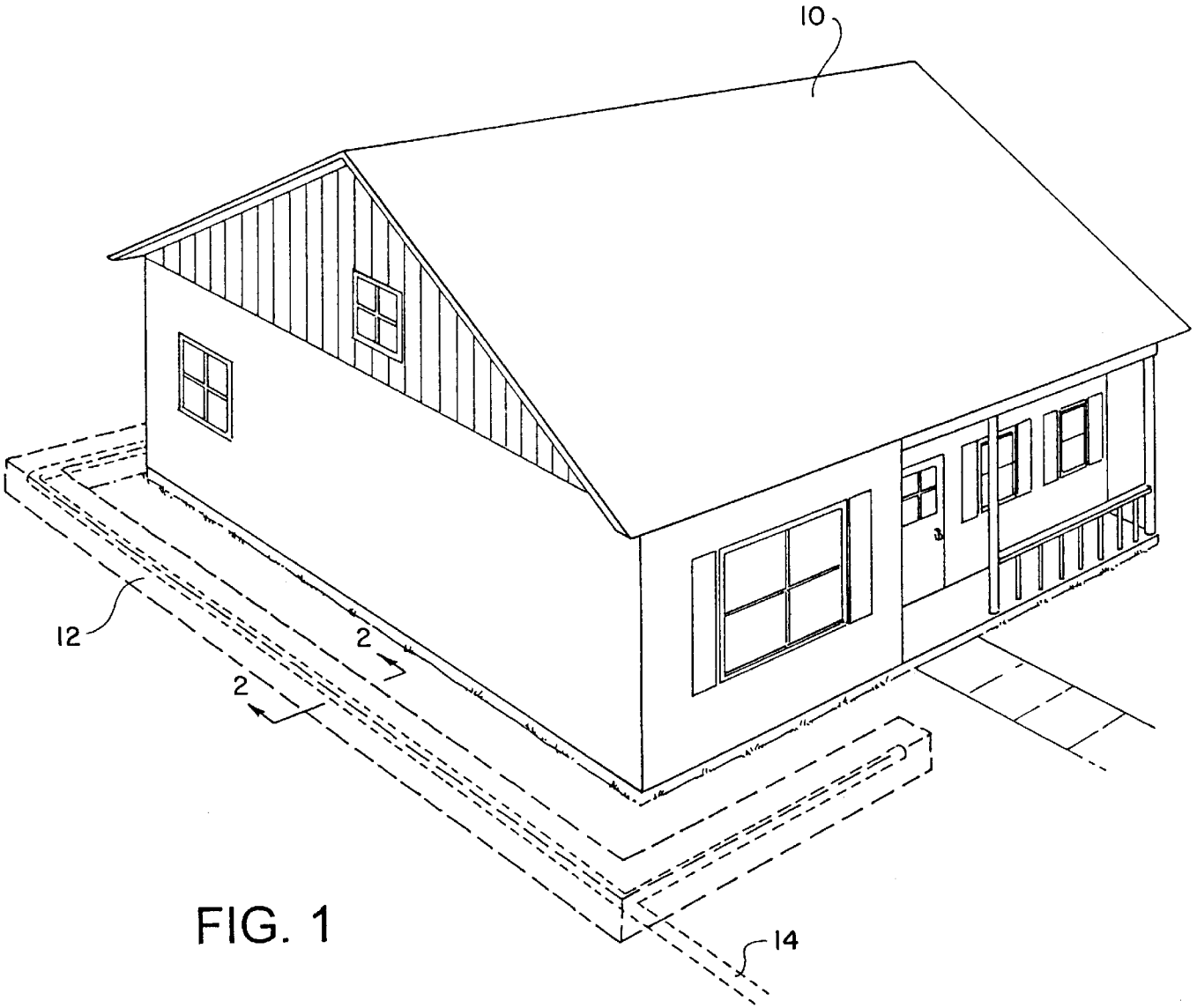
FIG. 1 is a perspective view of a building with a French drain.
Figure 2:
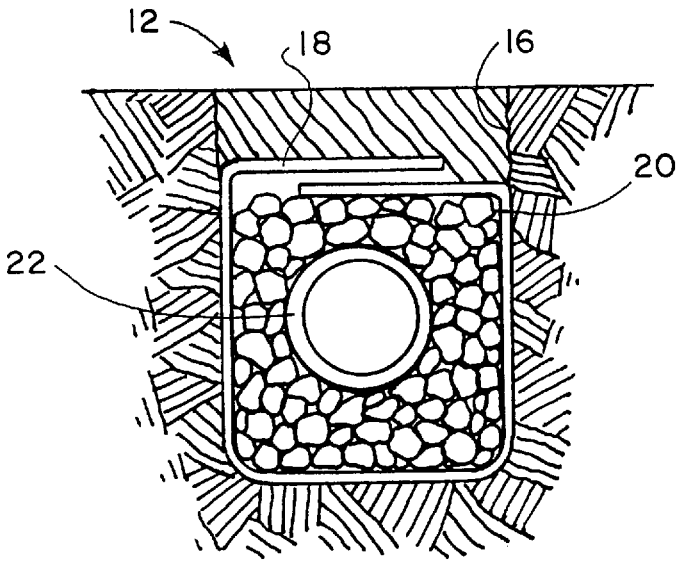
FIG. 2 is a sectional view taken along lines 2—2 of FIG. 1.

Referring initially to FIGS. 1 and 2, building 10 is constructed with a French drain 12 about its perimeter. As will be familiar to those skilled in this art, French drain 12 serves to collect water flowing off of building 10 and from surrounding higher areas and deliver it to outlet pipe 14. French drain 12 includes a trench 16, filter fabric 18, gravel 20, and perforated pipe 22. Filter fabric 18 is used to restrain soil movement, but will allow very fine soil to be carried away with the water. Larger soil particles are left behind to form a more permeable graded soil filter adjacent to the fabric, which effectively stops piping of the natural soils.

Figure 3:
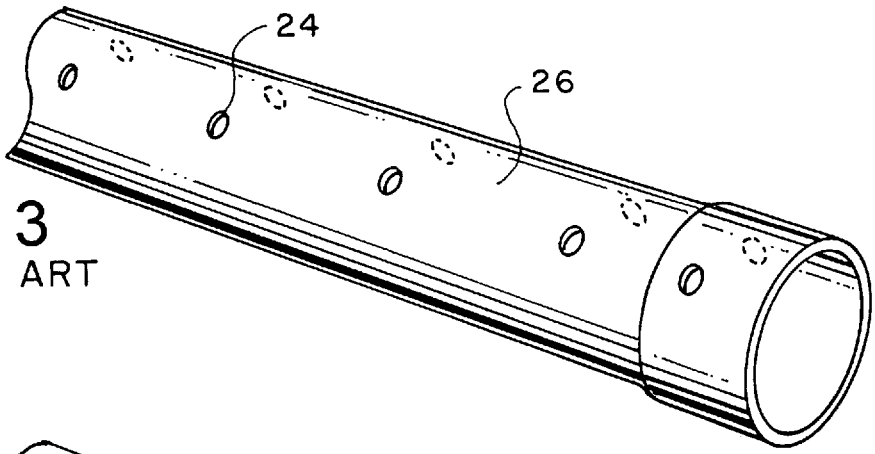
FIG. 3 PRIOR ART
FIGS. 3 and 4 are perspective views of prior art perforated drainage pipes.

Referring now to FIG. 3, the prior art hand-perforated drain pipe is illustrated. As can be seen, apertures 24 in drain pipe 26 are of relatively large diameter, which causes the apertures to be frequently plugged by adjacent gravel. In addition, relatively little attention has been paid to optimizing the number of openings or their placement about the pipe.

Figure 4:
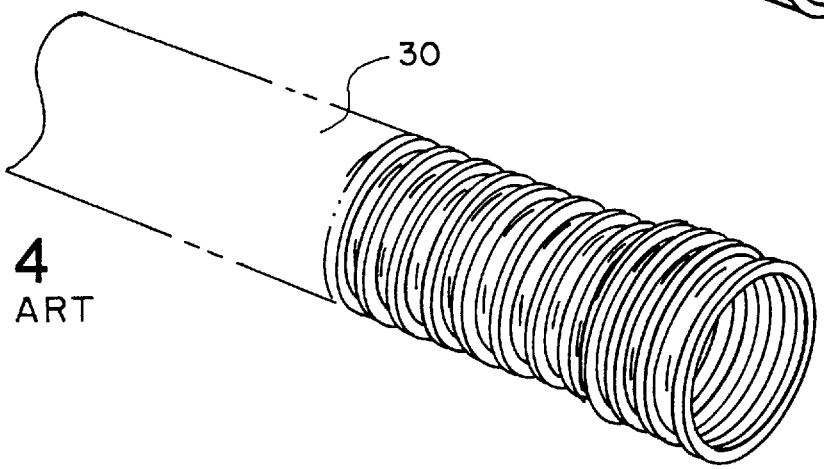
FIG. 4 PRIOR ART

FIG. 4 illustrates the prior art septic tank drain pipe 30 that has been used. This prior art pipe includes a plurality of non-angled cuts around the pipe as well as a corrugated construction.

Figure 5:
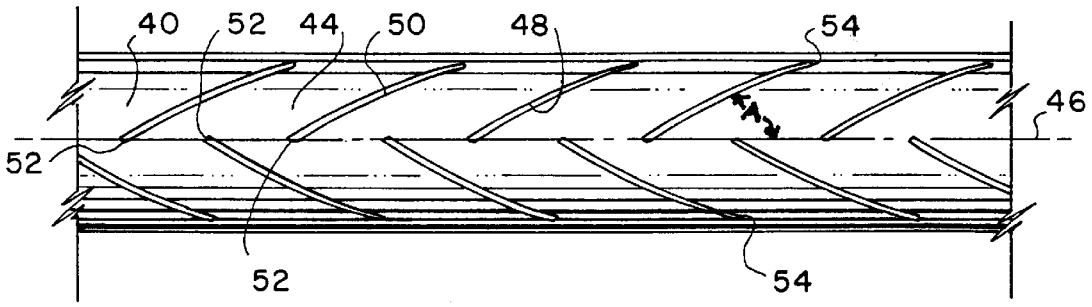
FIG. 5 is a top view of the improved perforated pipe of the present invention.
Figure 6:
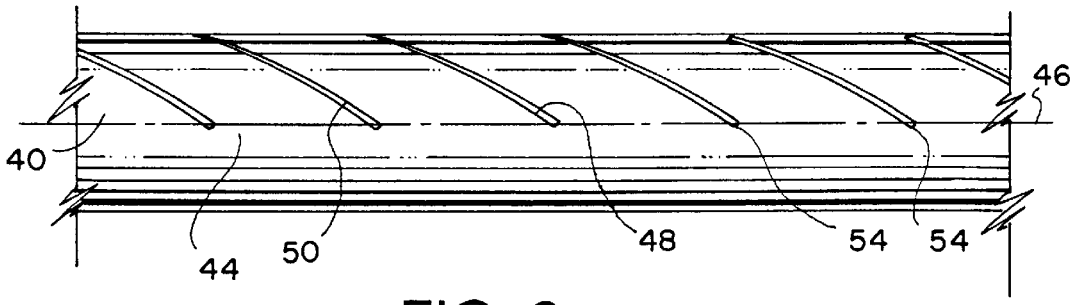
FIG. 6 is a side view of the pipe of FIG. 5.
Figure 7:
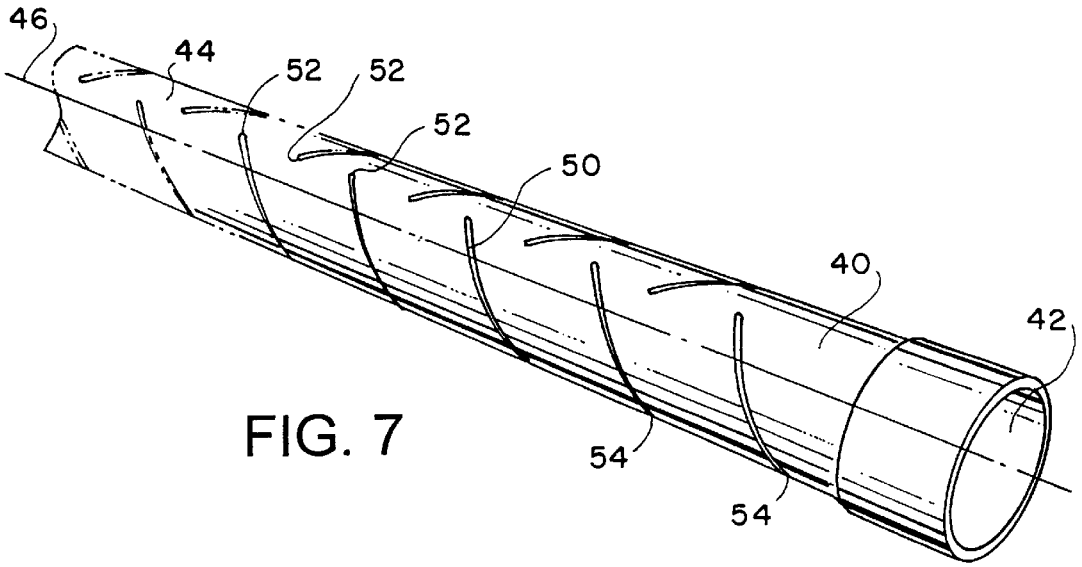
FIG. 7 is a perspective view of the improved pipe.

Referring now to FIGS. 5, 6 and 7, the improved subsurface drainage pipe has a tubular main pipe body 40 having inner and outer surfaces 42, 44. Inner and outer surfaces 42, 44 are circular in cross-section about a central axis 46. Walls 48 define a plurality of slot shaped apertures 50 through the inner and outer surfaces 42, 44 along the length of the main pipe body 40. Preferably, apertures 50 are about ⅛ inch wide and angled with respect to the central axis 46 by about 25 degrees. As best shown in FIG. 5, angle A is about 25 degrees and a range of 20–35 degrees is preferred.

Again, as best shown in FIG. 5, slot shaped apertures 50 have longitudinally-aligned first ends 52 spaced along the main pipe body 40 about 2.25 inches apart. Apertures 50 extend from first ends 52 to second ends 54 located about 90° main pipe body 40. Second ends 54 preferably are located alternatively on opposite sides of the main type body 40. Second ends 54 on each of the opposite sides are longitudinally-aligned and spaced along the main pipe body 40 about 4.5 inches apart.

In operation, the angle-slotted French drain pipe of the present invention eliminates certain prevailing problems with conventional solutions and provides enhanced superior performance characteristics. The slots are angled on opposing sides of the pipe to effectively provide a contiguous water entrance opening as compared to prior art pipes perforated with holes or corrugated pipes having vertical cuts. The slots are angled to provide a Venturi effect to induct flow into and within the pipe. Movement of water over the outer surface of the pipe and then into the slots creates a self-flushing action to limit stoppage and provide longer performance life. The basic French drain requirement of a gravel-filled trench will not block follow of water thorough the slots, as may occur with pipe perforated with holes. In many cases in the past, filter cloth around the perforated pipe was necessary to prevent gravel from entering the pipe and causing a stoppage. Filter cloth with clinging sediment and gravel at the perforations encourages stoppage and limits flow, while the small filter area around the pipe is also more quickly blocked with sediment. The requirement of filter cloth adjacent to the pipe is completely eliminated with the present invention. Only the trench need be lined with filter cloth, which greatly improves water flow and expected lifetime of the drain. The pipe of the present invention does not require any filter cloth adjacent to it due to the elongated self-flushing design of the apertures.

Whereas, the present invention has been described with respect to a specific embodiment thereof, it will be understood that various changes and modifications will be suggested to one skilled in the art, and it is intended to encompass such changes and modifications as fall within the scope of the appended claims.

We claim:

1. A subsurface drainage pipe, comprising:

a tubular main pipe body having inner and outer surfaces and a longitudinal central axis;

the inner and outer surfaces being circular in cross-section about the central axis;

walls defining a plurality of slot-shaped apertures through the inner and outer surfaces along the length of the main pipe body;

the slot-shaped apertures being about ⅛ inch wide;

the slot-shaped apertures being angled with respect to the central axis about 25 degrees;

the slot-shaped apertures having longitudinally-aligned first ends spaced along the main pipe body about 2.25 inches apart;

the slot-shaped apertures extending from the first ends to second ends located about 90 degrees around the main pipe body; and the second ends being located alternately on opposite sides of the main pipe body, with the second ends on each of the opposite sides being longitudinally-aligned and spaced along the main pipe body about 4.5 inches apart.

2. A subsurface drain, comprising:

a subsurface trench;

permeable media within the trench;

a subsurface drainage pipe within the permeable media;

the subsurface drainage pipe including a tubular main pipe body having inner and outer surfaces and a longitudinal central axis;

walls defining a plurality of slot-shaped apertures through the inner and outer surfaces along the length of the main pipe body;

the slot-shaped apertures being angled with respect to the central axis;

with the slot-shaped apertures having longitudinally-aligned first ends spaced along the main pipe body about 2.25 inches apart;

with the slot-shaped apertures extending from the first ends to second ends located about 90 degrees around the main pipe body; and with the second ends being located alternately on opposite sides of the main pipe body.

3. The subsurface drain of claim 2 with the second ends on each of the opposite sides being longitudinally-aligned.

4. The subsurface drain of claim 3 with the second ends on each of the opposite sides being spaced along the main pipe body about 4.5 inches apart.

5. A subsurface drain, comprising:

a subsurface trench;

permeable media within the trench;

a subsurface drainage pipe within the permeable media;

the subsurface drainage pipe including a tubular main pipe body having inner and outer surfaces and a longitudinal central axis;

the inner and outer surfaces being circular in cross-section about the central axis;

walls defining a plurality of slot-shaped apertures through the inner and outer surfaces along the length of the main pipe body;

the slot-shaped apertures being about ⅛ inch wide;

the slot-shaped apertures being angled with respect to the central axis about 25 degrees;

the slot-shaped apertures having longitudinally-aligned first ends spaced along the main pipe body about 2.25 inches apart;

the slot-shaped apertures extending from the first ends to second ends located about 90° degrees around the main pipe body; and the second ends being located alternately on opposite sides of the main pipe body, with the second ends on each of the opposite sides being longitudinally-aligned and spaced along the main pipe body about 4.5 inches apart.

* * * * *